US010598326B2

(12) United States Patent
Hou et al.

(10) Patent No.: US 10,598,326 B2
(45) Date of Patent: Mar. 24, 2020

(54) UNIVERSAL TYPE MOUNTING STRUCTURE FOR CAR LAMP BULB AND METHOD FOR ASSEMBLING UNIVERSAL TYPE MOUNTING STRUCTURE FOR CAR LAMP BULB WITH BULB

(71) Applicant: H.A. AUTOMOTIVE SYSTEMS, INC., Wuhan (CN)

(72) Inventors: Hao Hou, Wuhan (CN); Jingquan Li, Wuhan (CN); Xianfeng Lu, Wuhan (CN); Yuan Zhang, Wuhan (CN)

(73) Assignee: H.A. AUTOMOTIVE SYSTEMS, INC., Wuhan (CN)

( * ) Notice: Subject to any disclaimer, the term of this patent is extended or adjusted under 35 U.S.C. 154(b) by 0 days.

(21) Appl. No.: 16/340,485

(22) PCT Filed: May 8, 2017

(86) PCT No.: PCT/CN2017/083412

§ 371 (c)(1),
(2) Date: Apr. 9, 2019

(87) PCT Pub. No.: WO2018/068503

PCT Pub. Date: Apr. 19, 2018

(65) Prior Publication Data

US 2019/0242542 A1 Aug. 8, 2019

(30) Foreign Application Priority Data

Oct. 11, 2016 (CN) ..... 2016 1 0886794
Oct. 11, 2016 (CN) ..... 2016 2 1113271 U

(51) Int. Cl.
*F21S 41/172* (2018.01)
*F21S 41/19* (2018.01)
*F21V 17/14* (2006.01)
*F21W 107/10* (2018.01)

(52) U.S. Cl.
CPC ..... *F21S 41/172* (2018.01); *F21S 41/192* (2018.01); *F21S 41/194* (2018.01); *F21V 17/14* (2013.01); *F21W 2107/10* (2018.01)

(58) Field of Classification Search
None
See application file for complete search history.

(56) References Cited

U.S. PATENT DOCUMENTS

2011/0058384 A1* 3/2011 Boroczki ..... F21S 41/17 362/538
2011/0286224 A1* 11/2011 Nomura ..... F21S 41/196 362/396

* cited by examiner

*Primary Examiner* — Ashok Patel
(74) *Attorney, Agent, or Firm* — CBM Patent Consulting, LLC

(57) ABSTRACT

A universal type mounting structure for a car lamp bulb and a method for assembling the universal type mounting structure for a car lamp bulb with a bulb. The universal type mounting structure for a car lamp bulb is used for assembling the bulb by being cooperated with a bulb base and includes a contact piece, a reflecting mirror mounting part and a supporting seat, wherein the supporting seat is arranged in the reflecting mirror mounting part. According to the universal type mounting structure for a car lamp bulb, the assembly of arranged parts and the bulb is completed according to assembly procedures, so that high mounting convenience and dismounting convenience (single-hand mounting can be performed) are guaranteed.

9 Claims, 10 Drawing Sheets

UNIVERSAL TYPE MOUNTING STRUCTURE FOR CAR LAMP BULB AND METHOD FOR ASSEMBLING UNIVERSAL TYPE MOUNTING STRUCTURE FOR CAR LAMP BULB WITH BULB

BACKGROUND OF THE INVENTION

Technical Field

The present invention relates to an automotive lamp, and particularly relates to a universal type mounting structure for a car lamp bulb and a method for assembling the universal type mounting structure for a car lamp bulb with a bulb.

Prior Arts

A mounting structure for a conventional discharge bulb is in several forms as follows:

the discharge bulb is fixed on a reflector by dint of an elastic component of a metal snap spring, in such a manner, the discharge bulb takes no rotary motion, so that the discharge bulb is difficulty replaced by one hand;

the discharge bulb is fixed on the reflector by dint of a rotatable ring-shaped part, in such a manner, the discharge bulb takes no rotary motion, and the ring-shaped part takes rotary motion, so that the discharge bulb is difficulty replaced by one hand; and the discharge bulb is fixed on the reflector by dint of the rotatable ring-shaped part, in such a manner, the discharge bulb takes rotary motion, and the ring-shaped part also takes rotary motion, so that the discharge bulb is difficulty replaced by one hand.

Specification of Chinese application number "201110201342.6" discloses a mounting structure for a D3S type car lamp bulb and a method for implementing the assembly of the mounting structure for the D3S type car lamp bulb. The mounting structure includes a lamp base, wherein two semi-circular supporting seats with hook angles respectively are arranged on a bulb mounting position at one side of the lamp base, the two supporting seats are assembled with each other through respective hook angles, and the two supporting seats are mutually connected and cooperated with the lamp base through a lamp base ring sleeve; an elastic connective component is arranged on the outer ring of the lamp base ring sleeve in a hooping manner; a supporting seat assembly is formed in a manner that the elastic connective component is connected with the shell of one supporting seat; the inner ring of the supporting seat of the supporting seat assembly is mutually cooperated with the tail end of the D3S type car lamp bulb; and the D3S type car lamp bulb is screwed into the supporting seats and the lamp base.

The discharge bulb described in the technical scheme is fixed on the reflector by dint of the ring-shaped part fixed on the reflector as well as a movable auxiliary component entered from outside, in such a manner, the discharge bulb takes rotary motion, so that the discharge bulb is difficulty replaced by one hand.

Specification of Chinese application number "201210244117.5" discloses a bulb mounting structure for the automotive lamp. The bulb mounting structure includes a reflecting mirror base, a contact piece and a lamp supporting seat, wherein the contact piece is mounted on the mounting surface of the reflecting mirror base; the lamp supporting seat is mounted in the reflecting mirror base; the contact piece is mounted on five rivet columns located on the reflecting mirror base through five mounting holes; the bottom surface of the contact piece is adhered to the mounting surface of the reflecting mirror base for location; and three clamping feet located on the contact piece are non-uniformly and circumferentially arranged at different angles to prevent false mounting occurred when the bulb is mounted and correspond to three open slots formed in the bulb.

The discharge bulb described in the technical scheme is fixed on the reflector by dint of the ring-shaped part fixed on the reflector as well as the movable auxiliary component inside the reflector, in such a manner, the discharge bulb takes rotary motion, so that the discharge bulb is easily replaced by one hand.

All of the four mounting modes mentioned above have the problems of poor mounting convenience. Although the convenience for mounting is achieved and the discharge bulb can be replaced by one hand according to the last mounting mode of the four, the universality is poor, and the mounting structure is only adapted to a D5S discharge bulb with at least three square notches formed in a mounting flange (while most of bulbs only possess one square notch).

BRIEF SUMMARY OF THE INVENTION

In order to solve the problems, the present invention provides a universal type mounting structure for a car lamp bulb and an assembly method thereof. According to the universal type mounting structure provided by the present invention, the mounting convenience and dismounting convenience of the discharge bulb are guaranteed, besides the universality of the mounting structure is improved, so that the universal type mounting structure for a car lamp bulb is suitable for many kinds of discharge bulbs, and possesses a large adjustable range of a screwing angle. In addition, high radial locating accuracy can be improved or guaranteed according to the present invention. The technical scheme of the present invention is specifically as follows:

A universal type mounting structure for a car lamp bulb, which is used for mounting the bulb by being cooperated with a bulb base and includes a contact piece (1), a reflecting mirror mounting part (2) and a supporting seat (3) arranged in the reflecting mirror mounting part (2), is characterized in that a clamping foot (4) is arranged on the contact piece (1);

a semi-circular pressing sheet (5) is arranged on the contact piece (1);

a row (of) pressing sheet (6) is arranged on the contact piece (1) in manner of extending towards two sides by taking a position opposite to the clamping foot (4) as a datum point;

the reflecting mirror mounting part (2) includes a first cylindrical hole (7), a first supporting plane (8), a second cylindrical hole (9) and a second supporting plane (10); wherein the first supporting plane (8) is arranged between the first cylindrical hole (7) and the second cylindrical hole (9) and extends from the radial periphery outside the first cylindrical hole (7) to the inner diameter of the second cylindrical hole (9);

the second supporting plane (10) is arranged in manner of extending from the radial periphery outside the second cylindrical hole (9);

three fan-shaped lug bosses including a fan-shaped lug boss 1 (11-1), a fan-shaped lug boss 2 (11-2) and a fan-shaped lug boss 3 (11-3) respectively are distributed on the first supporting plane (8) and the inner wall of the second cylindrical hole (9), and an area formed by the three fan-shaped lug bosses is in the shape of a waist-shaped slot;

the contact piece (1) is arranged on the second supporting plane (10);

the supporting seat (3) is arranged in the waist-shaped slot formed by the three fan-shaped lug bosses, a lug boss (12) is arranged on the supporting seat (3), and the lug boss (12) is located just below the clamping foot (4) in an axial direction, so that the supporting seat (3) cannot drop out of the reflecting mirror mounting part (2);

a pair of axially arranged guide surfaces (13) are symmetrically arranged on the wall of the second cylindrical hole (9), and two V-shaped locating surfaces (14) at an angle of 90 degrees are arranged on the wall of the second cylindrical hole (9) along the axial direction.

According to the universal type mounting structure for a car lamp bulb, which is disclosed by the present invention, wherein a limiting lug boss (15) is arranged between the fan-shaped lug boss 1 (11-1) and the fan-shaped lug boss 2 (11-2) and on the side surface of the fan-shaped lug boss 1 (11-1), the left side surface of the limiting lug boss (15) and the side surface of the lug boss (12) located on the supporting seat (3) are cooperated to limit the position of a bulb being screwed in, and the right side surface of the fan-shaped lug boss 1 (11-1) and the side surface of the lug boss (12) located on the supporting seat (3) are cooperated to limit the position of a bulb being screwed out and prevent reverse screw;

according to the universal type mounting structure for a car lamp bulb, which is disclosed by the present invention, wherein a contact type pressing slice (16) is arranged on the wall of the second cylindrical hole (9) and opposite to the V-shaped locating surfaces (14), and the contact type pressing slice (16) is used for providing thrust in a radial direction for the supporting seat (3), so that the supporting seat (3) takes translational motion in the radial direction;

according to the universal type mounting structure for a car lamp bulb, which is disclosed by the present invention, wherein a contact piece (17) is arranged on the wall of the second cylindrical hole (9) and between the two V-shaped locating surfaces (14), elastic pieces (18) are arranged on two ends of the contact piece (17) in directions extending towards a circle center, and the elastic pieces (18) are used for propping the bulb back to an initial mounting position when the bulb is screwed out;

according to the universal type mounting structure for a car lamp bulb, which is disclosed by the present invention, wherein a pentagonal lug boss (19) is arranged on the supporting seat (3), and the pentagonal lug boss (19) is used for preventing the supporting seat (3) from moving downwards to a final mounting position by being hooked on the reflecting mirror mounting part (2) when the supporting seat (3) is placed on the initial mounting position;

according to the universal type mounting structure for a car lamp bulb, which is disclosed by the present invention, wherein four elastic contact pieces (20) are uniformly arranged on the periphery of the contact piece (1), and the elastic contact pieces (20) are used for improving electromagnetic compatibility by contacting with the metal shell of a back starter after the bulb is mounted in place;

according to the universal type mounting structure for a car lamp bulb, which is disclosed by the present invention, wherein an arc corresponding to the arc length between the side surface of the fan-shaped lug boss 1 (11-1) and the limiting lug boss (15) is 6-50 degrees.

A method for assembling the universal type mounting structure for a car lamp bulb with the bulb is characterized in that the bulb includes a bulb base on which a flange is formed, and a square notch and a semi-circular notch are formed in the flange; through the bulb base, the bulb and the universal type mounting structure for a car lamp bulb are assembled according to the following steps:

S1: the square notch formed in the flange of the bulb base is aligned to the clamping foot (4) located on the contact piece (1), the semi-circular notch formed in the flange of the bulb base is aligned to the semi-circular pressing sheet (5) located on the contact piece (1), the bulb is butted with the supporting seat (3) through the second cylindrical hole (9) and the first cylindrical hole (7) sequentially, and the square notch formed in the flange of the bulb base penetrates through the clamping foot (4) and in clearance fit with the lug boss (12) located on the supporting seat (3);

S2: the bulb is rotated, and the supporting seat (3) is driven and radially rotates in a direction from the fan-shaped lug boss 1 (11-1) to the limiting lug boss (15);

S3: when the supporting seat (3) rotates to the position of the contact type pressing slice (16), the contact type pressing slice (16) applies radial thrust to the supporting seat (3), the supporting seat (3) rotates and translates at the same time under the driving of the radial thrust and axial rotary force, and the bulb base rotates and translates at the same time under the action of the driving of the supporting seat (3) as well as applied own rotary force;

S4: when the supporting seat (3) is pushed into the narrow part of the waist-shaped slot in the radial direction, the supporting seat (3) rotates to the limiting lug boss (15) at the same time, the bulb base is pushed into the V-shaped locating surfaces (14) in the radial direction;

three-point fixation on the bulb base is formed by the clamping foot (4), the semi-circular pressing sheet (5) and the row pressing sheet (6).

According to the method for assembling the universal type mounting structure for a car lamp bulb with the bulb, which is disclosed by the present invention, wherein three bumps are uniformly formed on the bottom plane of the flange of the bulb base;

in step S4, when the bulb rotates in place, the three bumps move to the upper surfaces of the three fan-shaped lug bosses;

particularly, when the bulb rotates, one side of the flange gradually rotates to be below the clamping foot (4) and the semi-circular pressing sheet (5), clamping force is already generated on the flange once the flange is screwed into the clamping foot (4), and the clamping foot (4) is replaced from originally clamping the lug boss (12) located on the supporting seat (3) to clamp the flange; the translational motion of the flange causes that the other side of the flange gradually moves to be below the row pressing sheet (6), for the convenience of the flange to move below the row pressing sheet (6), the row pressing sheet (6) and the semi-circular pressing sheet (5) apply no clamping force to the flange at the moment; and the three bumps move from the inner parts of three grooves formed in the reflecting mirror mounting part (2) to the upper surfaces, namely the V-shaped locating surfaces (14), of the three fan-shaped lug bosses, the bulb takes upwards shifting motion at a distance of 0.3 mm along the axial direction at the moment. Relatively, the row pressing sheet (6) and the semi-circular pressing sheet (5) take downwards pressing motion on the flange, and the clamping force is generated at the moment.

According to the universal type mounting structure for a car lamp bulb and the assembly method thereof, firstly, in terms of own shape, the area formed by the three fan-shaped lug bosses is set into a shape of the waist-shaped slot, so that the preparation for motion location of the supporting seat (3) in a horizontal direction is made; a pair of the guide surfaces (13) extending longitudinally in the axial direction as well as the two V-shaped locating surfaces (14) at an angle of 90 degrees and extending longitudinally in the axial direction are symmetrically arranged on the wall of the second cylindrical hole (9), so that the preparation for motion location of the bulb base in the horizontal direction is made;

secondly, through the lug boss (12) arranged on the supporting seat (3) as well as the clamping foot (4) located on the contact piece (1), the supporting seat (3) and the bulb base are fixed into an integer for movement;

thirdly, the contact type pressing slice (16) is arranged on the wall of the second cylindrical hole (9) and opposite to the V-shaped locating surfaces;

the contact type pressing slice (16) is used for providing initial thrust in the radial direction of the supporting seat (3), so that the supporting seat (3) takes the translational motion in the radial direction, and meanwhile, the supporting seat (3) drives the bulb base to take the translational motion in the radial direction;

then, for further improving the structure, an auxiliary component is additionally arranged; the contact piece (17) is arranged on the wall of the second cylindrical hole (9) and between the two V-shaped locating surfaces (14), the elastic pieces (18) are arranged on two ends of the contact piece (17) in directions extending towards a circle center, and the elastic pieces (18) are used for propping the bulb back to the initial mounting position when the bulb is screwed out; the pentagonal lug boss (19) is arranged on the supporting seat (3), and the pentagonal lug boss (19) is used for preventing the supporting seat (3) from moving downwards to the final mounting position by being hooked on the reflecting mirror mounting part (2) when the supporting seat (3) is placed on the initial mounting position; and the four elastic contact pieces (20) are uniformly arranged on the periphery of the contact piece (1), and the elastic contact pieces (20) are used for improving electromagnetic compatibility by contacting with the metal shell of the back starter after the bulb is mounted in place.

According to the universal type mounting structure for a car lamp bulb and the assembly method thereof, not only high mounting convenience and dismounting convenience (single-hand mounting can be performed) is guaranteed, but also the universality (the universal type mounting structure for a car lamp bulb is suitable for many kinds of discharge bulbs) is improved, a screwing angle is large (obvious mounting hand feeling is guaranteed) and can be randomly adjusted within a specific range, and besides radial mounting accuracy is improved (the universal type mounting structure is directly located on a reflecting mirror in both axial direction and radial direction). In addition, the structure is small, and the electromagnetic compatibility can be improved.

Figure 1:
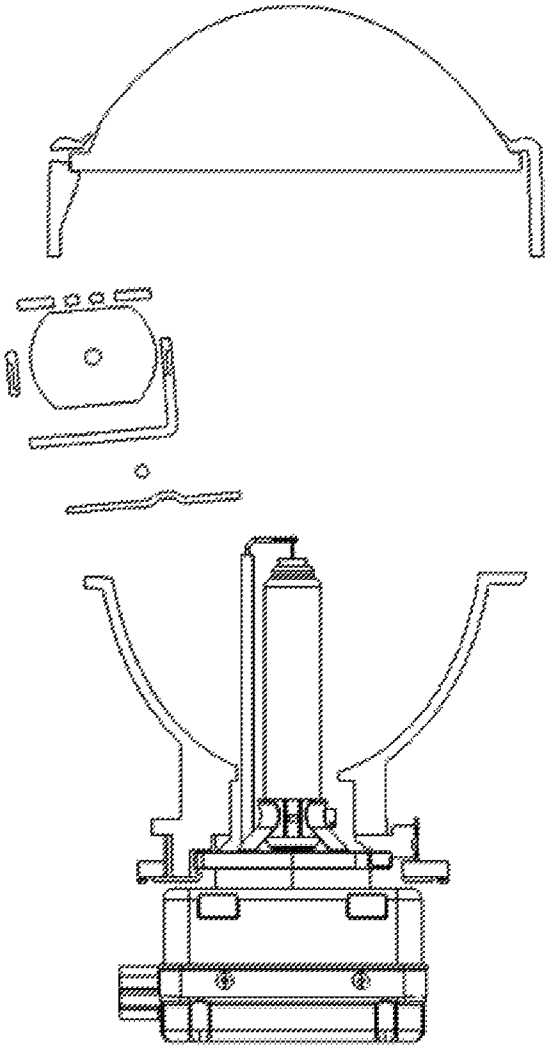
FIG. 1 is an assembly diagram of the universal type mounting structure of the present invention.
Figure 2:
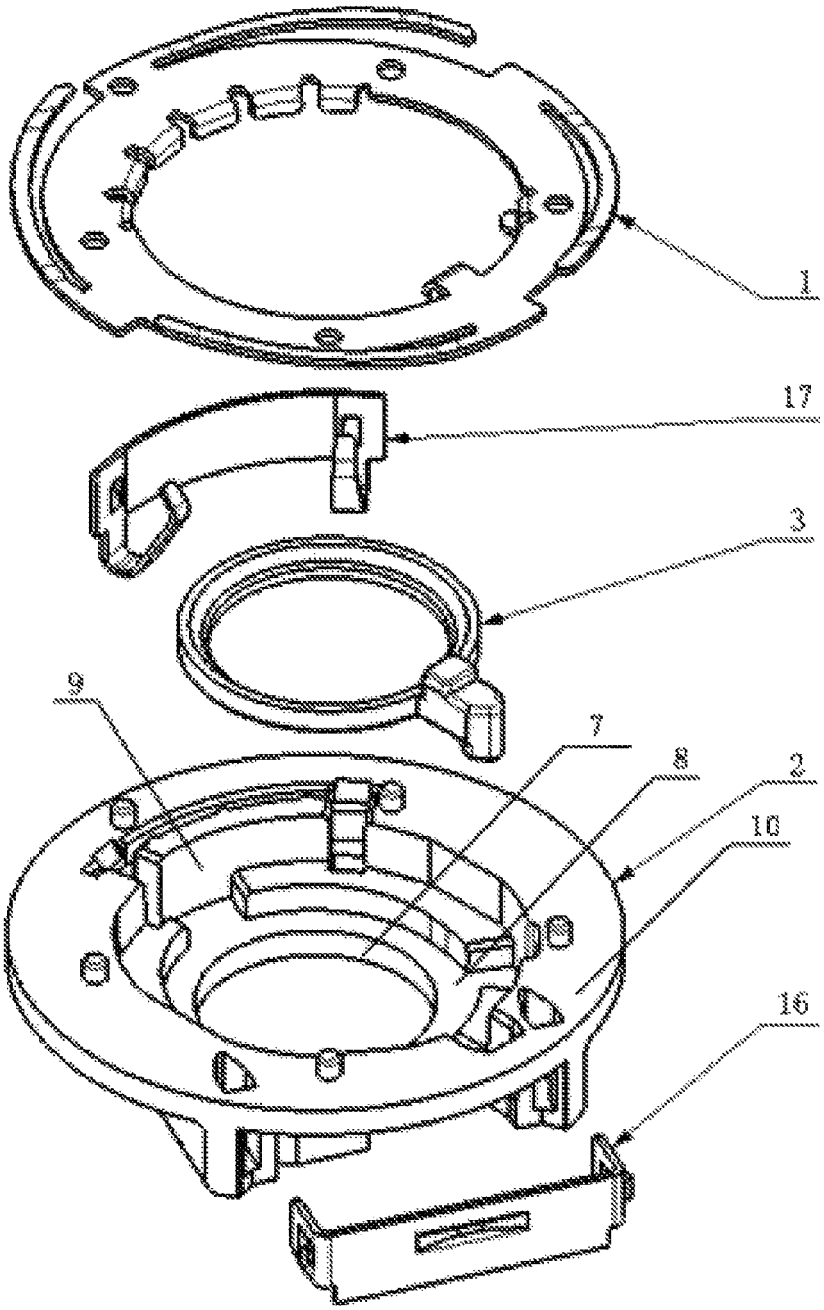
FIG. 2 is an explosion diagram of the assembly of the universal type mounting structure of the present invention.
Figure 3:
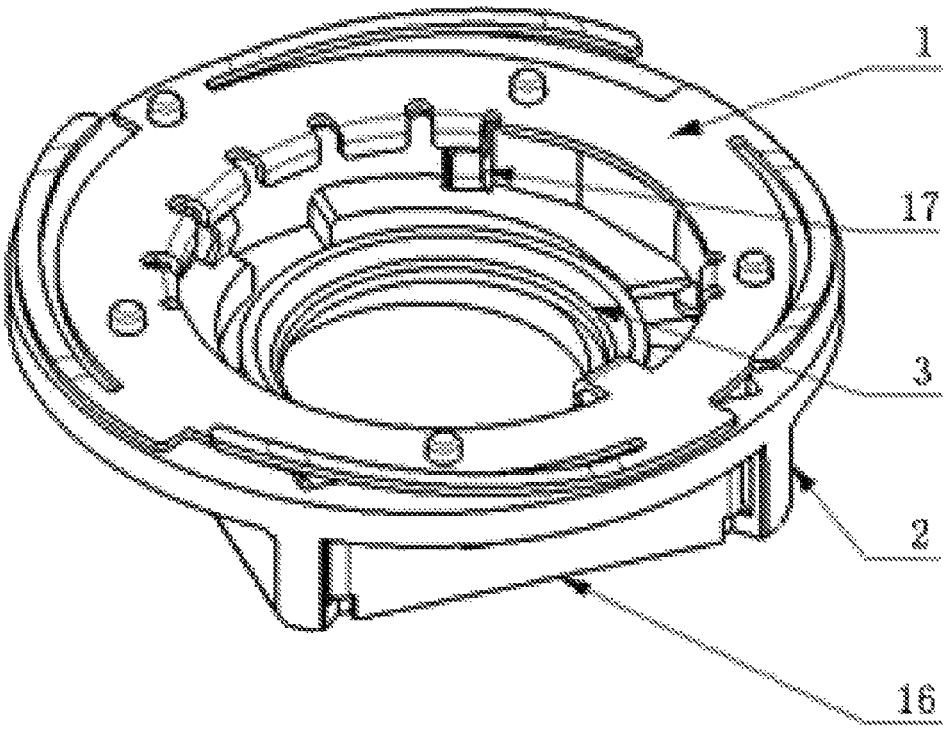
FIG. 3 is an axonometric drawing of the assembly of the universal type mounting structure of the present invention.
Figure 4:
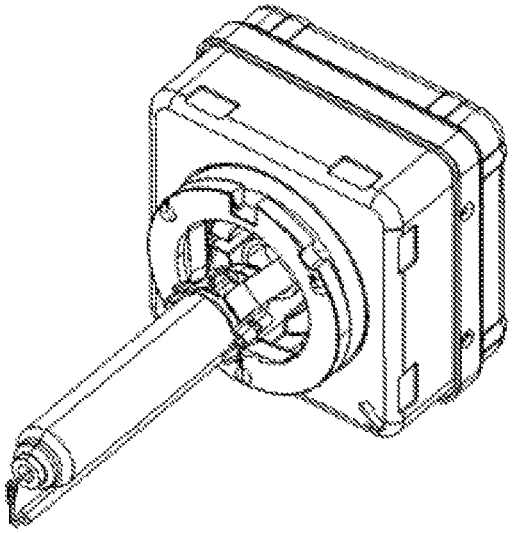
FIG. 4 is a structural schematic diagram of the discharge bulb of the present invention.
Figure 5:
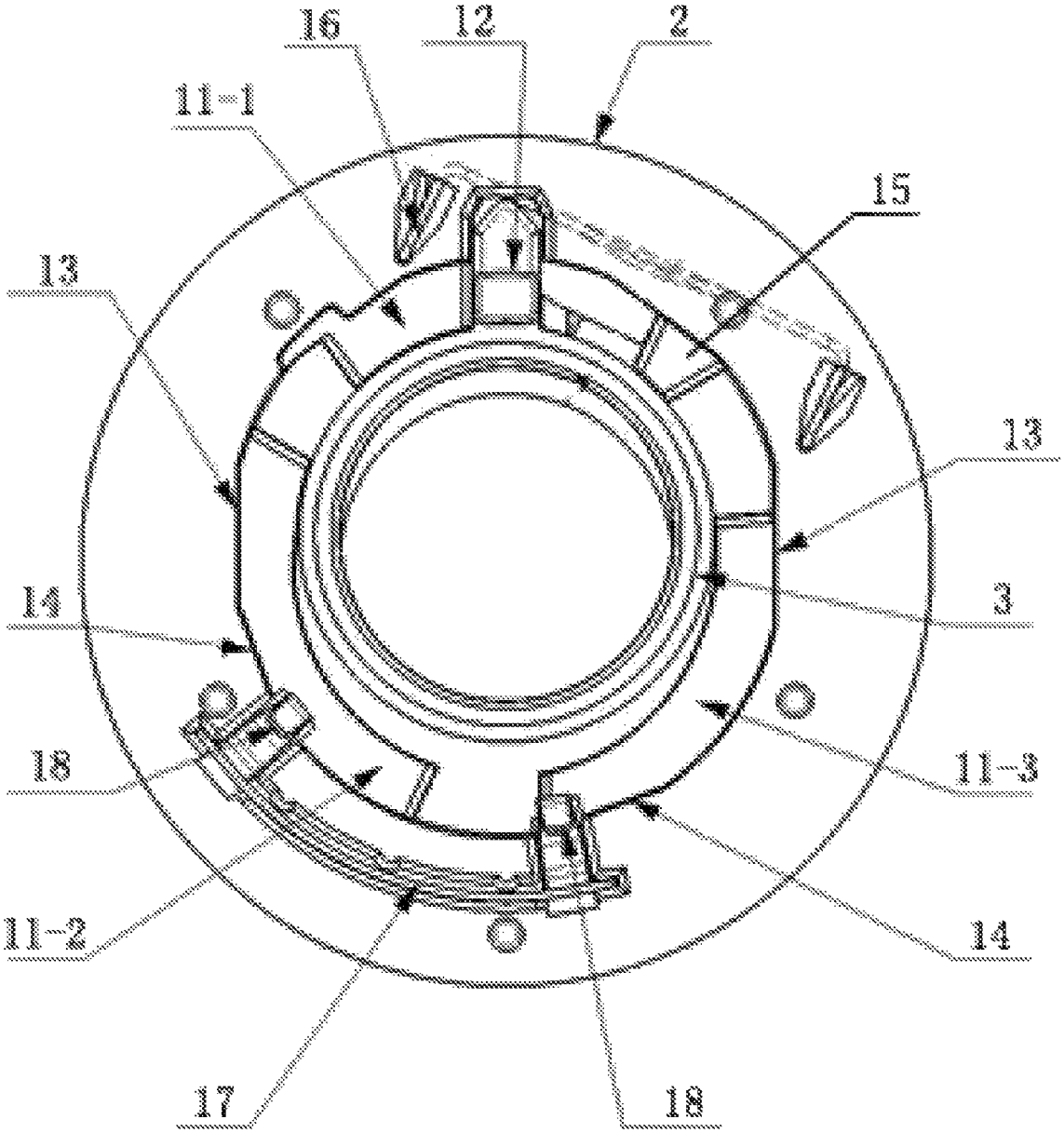
FIG. 5 is a front view (without the contact piece (1)) of the universal type mounting structure of the present invention.
Figure 6:
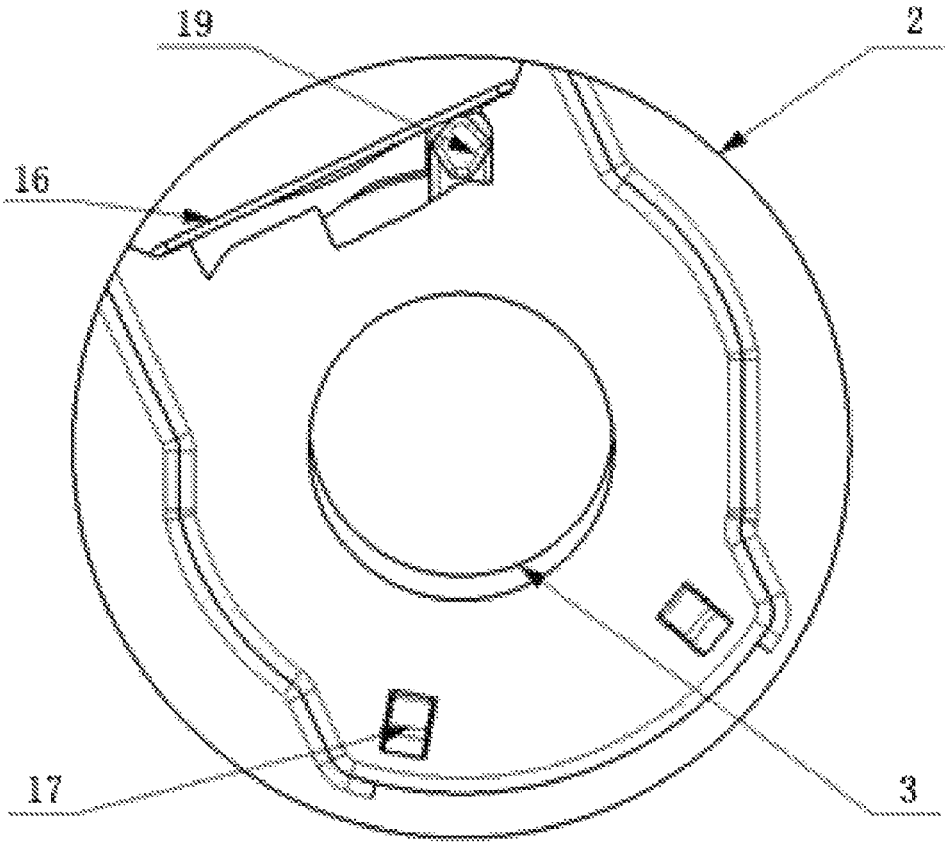
FIG. 6 is a back view of the assembly of the universal type mounting structure disclosed by the present invention.
Figure 7:
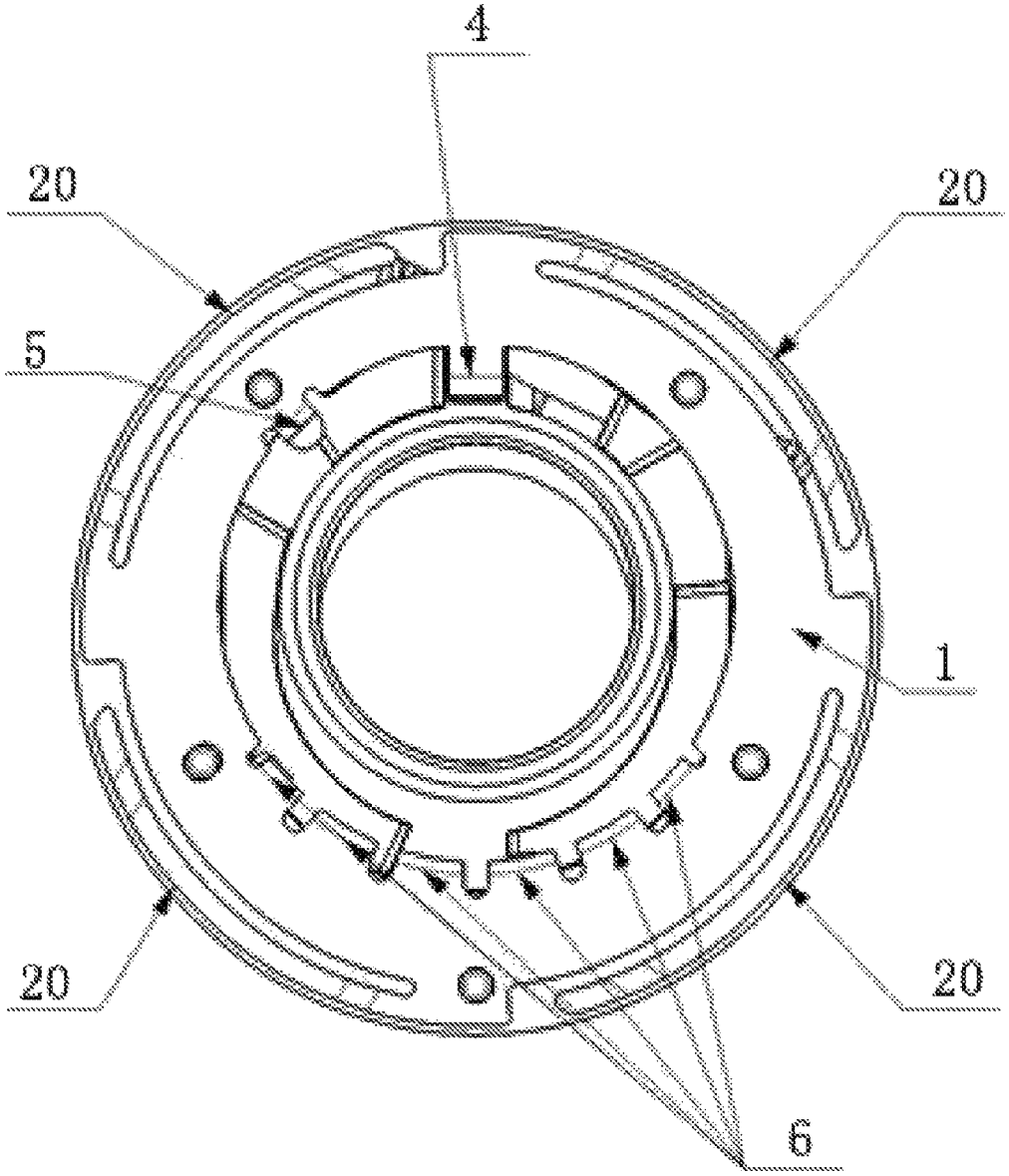
FIG. 7 is a front view of the assembly of the universal type mounting structure disclosed by the present invention.

In the figures, 1 represents the contact piece, 2 represents the reflecting mirror mounting part, 3 represents the supporting seat, 4 represents the clamping foot, 5 represents the semi-circular pressing slice, 6 represents the row pressing sheet, 7 represents the first cylindrical hole, 8 represents the first supporting plane, 9 represents the second cylindrical hole, 10 represents the second supporting plane, 11-1 represents the fan-shaped lug boss 1, 11-2 represents the fan-shaped lug boss 2, 11-3 represents the fan-shaped lug boss 3, 12 represents the lug boss, 13 represents the guide surfaces, 14 represents the V-shaped locating surfaces, 15 represents the limiting lug boss, 16 represents the contact type pressing slice, 17 represents the contact piece, 18 represents the elastic pieces, 19 represents the pentagonal lug boss, and 20 represents the elastic contact pieces.

DETAILED DESCRIPTION OF THE INVENTION

The universal type mounting structure for a car lamp bulb and the method for assembling the universal type mounting structure for a car lamp bulb with the bulb are further particularly explained as follows in combination with accompanying drawings in the specification as well as the detail description of the present invention.

The universal type mounting structure for a car lamp bulb as shown in FIG. 1-FIG. 7 is used for mounting the bulb by being cooperated with the bulb base, which includes the contact piece (1), the reflecting mirror mounting part (2) and the supporting seat (3), wherein the supporting seat (3) is arranged in the reflecting mirror mounting part (2);

the clamping foot (4) is arranged on the contact piece (1); the semi-circular pressing sheet (5) is arranged on the contact piece (1);

the row pressing sheet (6) is arranged on the contact piece (1) in manner of extending towards two sides by taking the position opposite to the clamping foot (4) as the datum point;

the reflecting mirror mounting part (2) includes the first cylindrical hole (7), the first supporting plane (8), the second cylindrical hole (9) and the second supporting plane (10);

the first supporting plane (8) is arranged between the first cylindrical hole (7) and the second cylindrical hole (9) and extends from the radial periphery outside the first cylindrical hole (7) to the inner diameter of the second cylindrical hole (9);

the second supporting plane (10) is arranged in manner of extending from the radial periphery outside the second cylindrical hole (9);

the three fan-shaped lug bosses including the fan-shaped lug boss 1 (11-1), the fan-shaped lug boss 2 (11-2) and the fan-shaped lug boss 3 (11-3) respectively are distributed on the first supporting plane (8) and the inner wall of the second cylindrical hole (9), and the area formed by the three fan-shaped lug bosses is in the shape of the waist-shaped slot;

the contact piece (1) is arranged on the second supporting plane (8);

the supporting seat (3) is arranged in the waist-shaped slot formed by the three fan-shaped lug bosses, the lug boss (12) is arranged on the supporting seat (3), and the lug boss (12) is located just below the clamping foot (4) in the axial direction, so that the supporting seat (3) cannot drop out of the reflecting mirror mounting part (2);

a pair of the guide surfaces (13) which are axially arranged are symmetrically arranged on the wall of the second cylindrical hole (9), and the two V-shaped locating surfaces (14) at an angle of 90 degrees are arranged on the wall of the second cylindrical hole (9) along the axial direction;

wherein, the limiting lug boss (15) is arranged between the fan-shaped lug boss 1 (11-1) and the fan-shaped lug boss 2 (11-2) and on the side surface of the fan-shaped lug boss 1 (11-1), the left side surface of the limiting lug boss (15) and the side surface of the lug boss (12) located on the supporting seat (3) are cooperated to limit the position of the bulb being screwed in, and the right side surface of the fan-shaped lug boss 1 (11-1) and the side surface of the lug boss (12) located on the supporting seat (3) are cooperated to limit the position of the bulb being screwed out and prevent reverse screw;

wherein, the contact type pressing slice (16) is arranged on the wall of the second cylindrical hole (9) and opposite to the V-shaped locating surfaces (14), and the contact type pressing slice (16) is used for providing thrust in the radial direction for the supporting seat (3), so that the supporting seat (3) takes translational motion in the radial direction;

wherein, the contact piece (17) is arranged on the wall of the second cylindrical hole (9) and between the two V-shaped locating surfaces (14), the elastic pieces (18) are arranged on two ends of the contact piece (17) in directions extending towards the circle center, and the elastic pieces (18) are used for propping the bulb back to the initial mounting position when the bulb is screwed out;

wherein, the pentagonal lug boss (19) is arranged on the supporting seat (3), and the pentagonal lug boss (19) is used for preventing the supporting seat (3) from moving downwards to the final mounting position by being hooked on the reflecting mirror mounting part (2) when the supporting seat (3) is placed on the initial mounting position;

wherein, the four elastic contact pieces (20) are uniformly arranged on the periphery of the contact piece (1), and the elastic contact pieces (20) are used for improving electromagnetic compatibility by contacting with the metal shell of the back starter after the bulb is mounted in place;

According to the universal type mounting structure for a car lamp bulb, which is disclosed by the present invention, wherein, the arc corresponding to the arc length between the side surface of the fan-shaped lug boss 1 (11-1) and the limiting lug boss (15) is 6-50 degrees.

Figure 8:
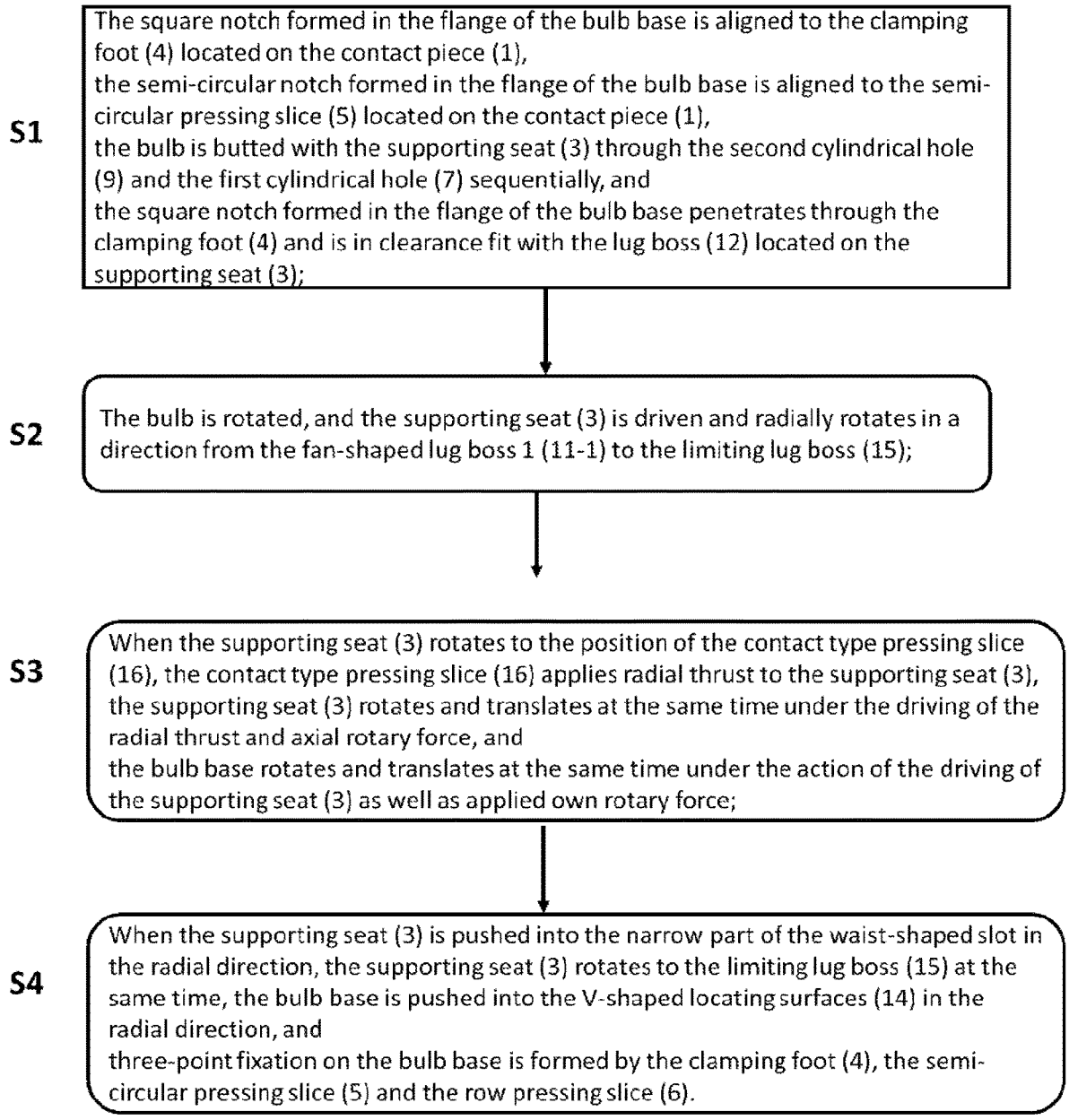
FIG. 8 is a mounting flow diagram of the universal type mounting structure disclosed by the present invention.

According to the method for assembling the universal type mounting structure for a car lamp bulb with the bulb as shown in FIG. 8, the bulb includes the bulb base, wherein the flange is formed on the bulb base, and the square notch and the semi-circular notch are formed in the flange; through the bulb base, the bulb and the universal type mounting structure for a car lamp bulb are assembled according to the following steps:

S1: the square notch formed in the flange of the bulb base is aligned to the clamping foot (4) located on the contact piece (1), the semi-circular notch formed in the flange of the bulb base is aligned to the semi-circular pressing sheet (5) located on the contact piece (1), the bulb is butted with the supporting seat (3) through the second cylindrical hole (9) and the first cylindrical hole (7) sequentially, and the square notch formed in the flange of the bulb base penetrates through the clamping foot (4) and in clearance fit with the lug boss (12) located on the supporting seat (3);

S2: the bulb is rotated, and the supporting seat (3) is driven and radially rotates in the direction from the fan-shaped lug boss 1 (11-1) to the limiting lug boss (15);

S3: when the supporting seat (3) rotates to the position of the contact type pressing slice (16), the contact type pressing slice (16) applies radial thrust to the supporting seat (3), the supporting seat (3) rotates and translates at the same time under the driving of the radial thrust and axial rotary force, and the bulb base rotates and translates at the same time under the action of the driving of the supporting seat (3) as well as applied own rotary force;

S4: when the supporting seat (3) is pushed into the narrow part of the waist-shaped slot in the radial direction, the supporting seat (3) rotates to the limiting lug boss (15) at the same time, the bulb base is pushed into the V-shaped locating surfaces (14) in the radial direction, and three-point fixation on the bulb base is formed by the clamping foot (4), the semi-circular pressing sheet (5) and the row pressing sheet (6);

wherein the three bumps are uniformly formed on the bottom plane of the flange of the bulb base;

in step S4, when the bulb rotates in place, the three bumps move to the upper surfaces of the three fan-shaped lug bosses;

particularly, when the bulb rotates, one side of the flange gradually rotates to be below the clamping foot (4) and the semi-circular pressing sheet (5), the clamping force is already generated on the flange once the flange is screwed into the clamping foot (4), and the clamping foot (4) is replaced from originally clamping the lug boss (12) located on the supporting seat (3) to clamp the flange; the translational motion of the flange causes that the other side of the flange gradually moves to be below the row pressing sheet (6), for the convenience for the flange to move below the row pressing sheet (6), the row pressing sheet (6) and the semi-circular pressing sheet (5) apply no clamping force to the flange at the moment; and the three bumps move from the inner parts of the three grooves formed in the reflecting mirror mounting part (2) to the upper surfaces, namely locating surfaces, of the three fan-shaped lug bosses, the bulb takes the upwards shifting motion at a distance of 0.3 mm along the axial direction at the moment, relatively, the row pressing sheet (6) and the semi-circular pressing sheet (5) take the downwards pressing motion on the flange, and the clamping force is generated at the moment.

Working Principle

The discharge bulb and the universal type mounting structure for a car lamp bulb are mounted as follows: the mounting clamping foot (4) and the mistake-proofing semi-circular pressing sheet (5) which are located on the contact piece (1) are aligned to a locating notch and specification identifying notch of the bulb and directly inserted into the bottoms of the bulb locating notch and the specification identifying notch, and then the bulb is mounted in place by being clockwise rotated at an angle of 25 degrees; when the bulb is on an initial screwing position, the lug boss (12) located on the supporting seat (3) is concealed just below the mounting clamping foot (4) located on the contact piece (1), and after the bulb is inserted, the lug boss (12) located on the supporting seat (3) is just clamped into the locating notch of the bulb, so that when the bulb is screwed towards the right, the supporting seat (3) is driven to rotate together till limiting (the rotational degree of freedom of an X axis is limited) is realized in a manner that the locating surface of the supporting seat (3) contacts with the locating surface of a mounting part.

When the bulb is screwed towards the right, the head part of the supporting seat (3) gradually props towards the contact type pressing slice (16), for the contact type pressing slice (16) and the mounting part are fixed, therefore, when the supporting seat (3) is screwed till contacting with the contact type pressing slice (16), the contact type pressing slice (16) applies an acting force on the supporting seat (3), so that the bulb is driven by the supporting seat (3) to be turned from independent rotation to synchronous translation and independent rotation. In addition, a cooperating position of the mounting part and the outer diameter of a bulb flange is in a waist-shaped hole structure, two waists play a guiding role, then the supporting seat (3) drives the bulb to move and independently rotate at the same time along the directions of the two waists, and the bulb is stopped when reaching a final screwing position; and the contact type pressing slice (16) and the supporting seat (3) are designed to be in interference fit on the final screwing position, therefore, the contact type pressing slice (16) applies the acting force on the bulb all the time to support the bulb against a V-shaped surface (the freedom degrees of Y/Z directions are limited).

Three locating points which are raised for 0.3 mm are arranged on the bottom plane of the flange of the bulb base, when the bulb is inserted into an initial position of the mounting part, the locating points are just suspended in the grooves, and the row pressing sheet (6) and the mistake-proofing semi-circular pressing sheet (5) which are located on the contact piece (1) are 0.3 mm higher than the bulb flange in a negative X direction; when the bulb is screwed in, the bulb takes rotary and linear motion, as such, the three locating points are transferred out of the grooves and located on the locating surface (limiting the rotational degree of freedom of a Y/Z shaft in an X direction) of the mounting part, namely the integral bulb is propped up for 0.3 mm along the negative X direction, the bulb flange moves to be below a row of clamping pressing slices, the mistake-proofing semi-circular pressing sheet (5) and the mounting clamping foot (4) at the same time. At the moment, the clamping pressing slices and the mistake-proofing semi-circular pressing sheet (5) just press on the bulb flange, wherein the mounting clamping foot (4) is in interference fit, and fixing and clamping effects are achieved through the clamping pressing slices, the mistake-proofing semi-circular pressing sheet (5) and the mounting clamping foot (4).

In addition, when the bulb is mounted in place, the contact piece (17) applies thrust on the circumference of the bulb flange all the time, and the direction of the thrust is basically reversed to the direction of the thrust provided by the contact type pressing slice (16); as the thrust provided by the contact type pressing slice (16) is designed to be much larger than the thrust provided by the contact piece (17), the direction of a resultant force also faces the V-shaped surface all the time, therefore location reliability is guaranteed.

The discharge bulb and the universal type mounting structure for a car lamp bulb are dismounted as follows: the discharge bulb anticlockwise rotates at an angle of 25 degrees to the initial screwing position, and then the bulb is pulled out; when the bulb reversely rotates, the contact type pressing slice (16) is gradually separated from the supporting seat (3), namely the thrust provided by the contact type pressing slice (16) is gradually reduced till being smaller than the thrust provided by the contact piece (17), under the action of the thrust provided by the contact piece (17), the bulb drives the supporting seat (3) to return to an initial insertion position along the directions of the two waists, and at the moment, the bulb can be smoothly pulled out.

Working process: the bulb is straightly inserted into the universal type mounting structure for a car lamp bulb along a direction of an optical axis, at the moment, the bulb is located on the initial mounting position, the square notch formed in the bulb flange is just cooperated with the lug boss (12) located on the supporting seat (3), and the three locating points arranged on the bulb flange are located in grooves formed in the inner sides of the three fan-shaped lug bosses located on the mounting part; then the bulb is clockwise rotated at a certain angle, at the moment, the bulb is still located on the initial mounting position, the bulb drives the supporting seat (3) to independently rotate together in a rotating process, the lug boss (12) located on the supporting seat (3) gradually moves out of the lower side of the clamping foot (4) located on the contact piece (1), the bulb flange gradually moves to be below the clamping foot (4) located on the contact piece (1), the pentagonal lug boss (19) located on the supporting seat (3) just contacts with the contact type pressing slice (16), and the three locating points arranged on the bulb flange are still located in the fan-shaped grooves formed in the mounting part; then the bulb is also clockwise rotated, at the moment, the supporting seat (3) contacts with the limiting lug boss (15) located on the mounting part, the bulb is located on the final mounting position, the bulb continues to drive the supporting seat (3) to rotate together in the rotating process, meanwhile, under the acting force of the contact type pressing slice (16), the supporting seat (3) drives the bulb to take translation motion along the guide surfaces of the mounting part, at the moment, although the bulb is stressed with the opposite acting force of the contact piece (17) as well, the elasticity of the contact piece (17) is set to be less than the elasticity of the contact type pressing slice (16), so that under the superposition motion of synchronous independent rotation and translation, the lug boss (12) located on the supporting seat (3) completely moves out of the lower side of the clamping foot (4), the bulb flange completely moves to be below the clamping foot (4), the other side of the bulb flange moves to be below the row pressing sheet (6) opposite to the clamping foot (4), the three locating points located on the bulb flange move from the grooves formed in the mounting part to a locating surface formed by the fan-shaped lug boss 1 (11-1), the fan-shaped lug boss 2 (11-2) and the fan-shaped lug boss 3 (11-3), the bulb is slightly raised (at own heights of the bumps) and simultaneously slightly props up the clamping foot (4) and the row pressing sheet (6) which are located on the contact piece (1), and a downwards clamping force is generated by the contact piece (1) on the bulb for realizing fixation. In the radial direction, under the resultant force of the contact type pressing slice (16) and the contact piece (17), the bulb is supported against the V-shaped locating surfaces (14) all the time, so that high radial locating accuracy is guaranteed.

Radial Location Analysis

Previous radial location of the bulb is performed through the inner diameter of an integral circumferential surface or the inner diameter of a partial circumferential surface; for the insertion convenience of the bulb, the inner diameter of the locating circumferential surface and the bulb flange are in clearance fit, and the bulb probably shifts in any directions, thus, the centering accuracy is poor. According to the universal type mounting structure for a car lamp bulb, location is performed through the cooperation of the V-shaped surface and the elastic contact pieces, the bulb can only shift in one direction, and no consideration on specially enlarging a locating circle (surface) for the insertion convenience of the bulb needs to be taken.

Location Error of the Circumferential Surface

Figure 9:
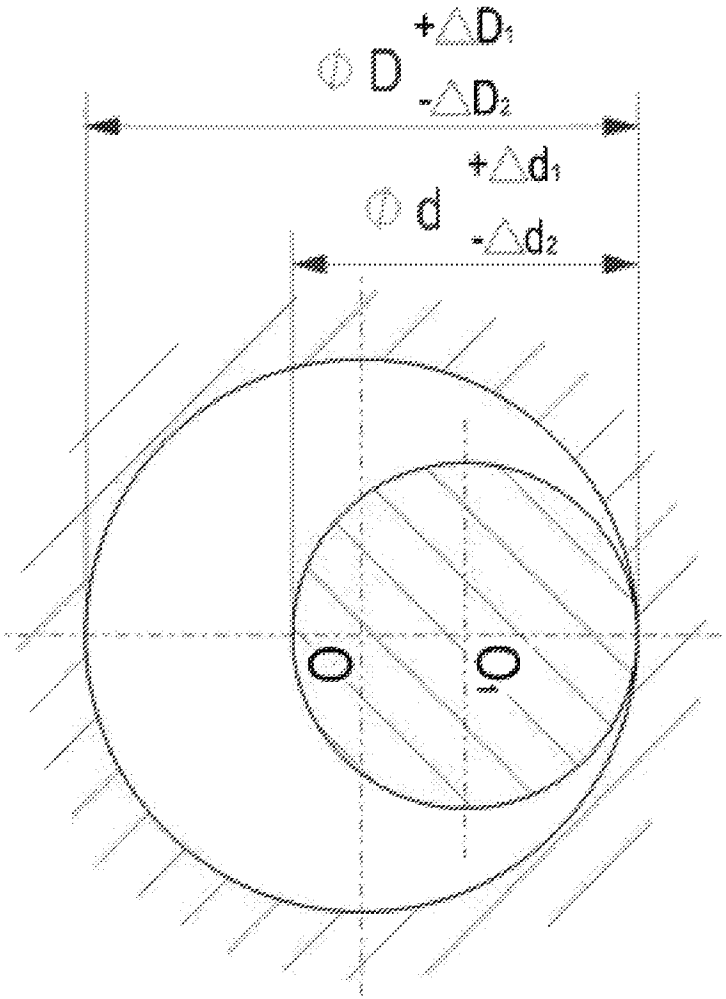
FIG. 9 is a schematic diagram of previous location error analysis of a circumferential surface.

The location error analysis of the circumferential surface is as follows: as shown in FIG. 9, the diameter of an inner hole of a locating circle is set as D(+delta D1/−delta D2), the outer diameter of the bulb flange is set as d(+delta d1/−delta d2), for the insertion convenience of the bulb, a minimum value of the inner diameter of the locating circle is larger than a maximum value of the outer diameter of the bulb flange, and minimum fit clearance between the inner diameter of the locating circle and the outer diameter of the bulb flange is set as X; the center O of the inner hole of the locating circle is taken as a location datum (an optical center of a reflecting surface), the center O1 of the bulb flange is taken as a bulb center, because the inner diameter of the locating circle and the outer diameter of the bulb flange have tolerance in dimension, and the minimum fit clearance between the inner diameter of the locating circle and the outer diameter of the bulb flange exists, the bulb center probably shifts in any direction relative to a locating center; if the inner diameter of the locating circle is maximum at D+delta D1, and the outer diameter of the bulb flange is minimum at d-delta d2, at the moment, the distance from the location datum O to a bulb center O1 is maximum, and maximum location error is $$\text{delta erroneous circle}=2*OO1=2*\left[(D+\text{delta } D1)-(d-\text{delta } d2)\right]/2=D-d+\text{delta } D1+\text{delta } d2,$$

$$\text{because } X=(D-\text{delta } D2)-(d+\text{delta } d1),\text{namely } D-d=\text{delta } D2+\text{delta } d1+X,$$

$$\text{delta erroneous circle}=\text{delta } D1+\text{delta } D2+\text{delta } d1+\text{delta } d2+X.$$

Location Error of the V-Shaped Surface

Figure 10:
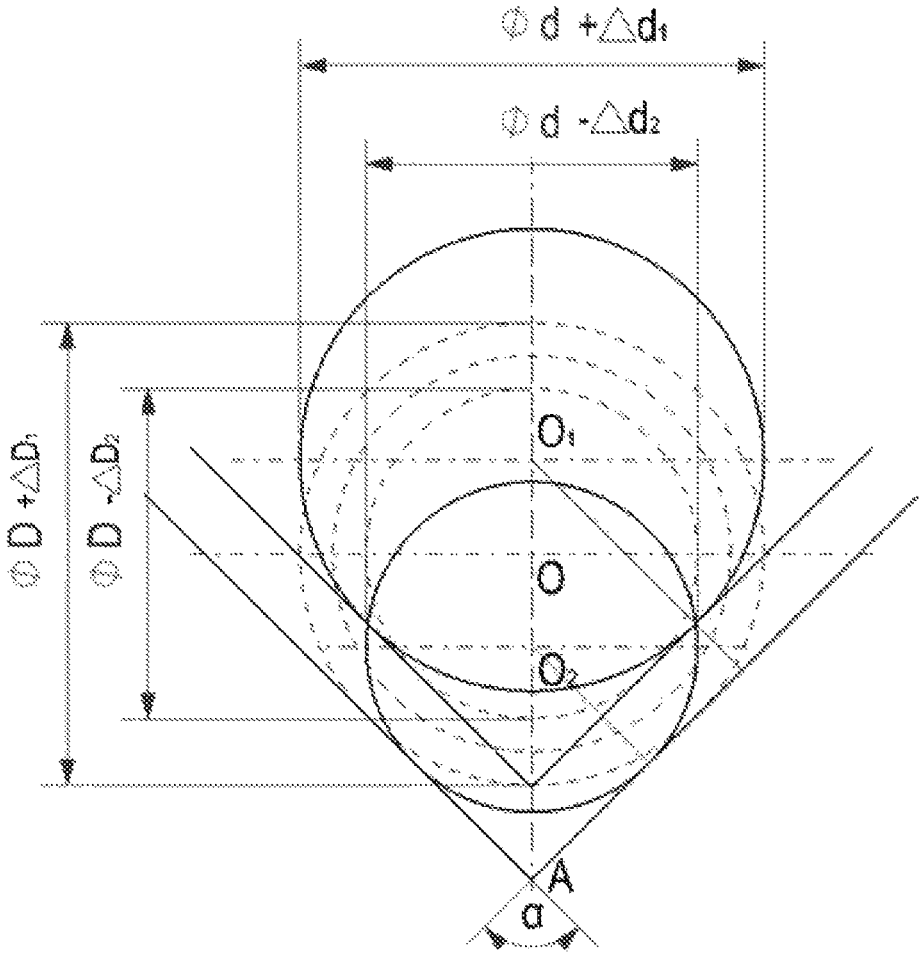
FIG. 10 is a schematic diagram of the location error analysis of the V-shaped locating surfaces (14).

The location error analysis of the V-shaped surface in combination with the elastic contact pieces is as follows: as shown in FIG. 10, the diameter of a circle with the locating V-shaped surface is set as D (+delta D1/−delta D2), the outer diameter of the bulb flange is set as d (+delta d1/−delta d2), because the locating surface in the structure is a V-shaped surface, and the bulb center is movable in a mounting process, no minimum fit clearance X exists between the diameter of the circle and the outer diameter of the bulb flange; because the locating V-shaped surface and the outer diameter of the bulb flange have tolerance in dimension, the bulb center probably shifts in an up-down direction of the V-shaped surface relative to the locating center; if the V-shaped surface is minimum, the bulb flange is maximum, at the moment, the bulb center O1 is relatively located above a locating center O; if the V-shaped surface is minimum, the bulb flange is minimum, at the moment, a bulb center O2 is relatively located below the locating center O, and a line-connecting distance O102 between two extreme positions is maximum location error;

as shown in FIG. 9, A represents the intersection point of the maximum V-shaped surface, and perpendicular lines pointing towards the center of a circle are respectively made on the tangent points of the V-shaped surface and the bulb flange, so that $$O1A=\left[(d+\text{delta } d1)/2+\left[(D+\text{delta } D1)-(D-\text{delta } D2)\right]/2\right]/\sin(\text{alpha}/2)$$

$$O2A=\left[(d-\text{delta } d2)/1\right]/\sin(\text{alpha}/2)$$

$$\text{delta erroneous } V=O1O2=O1A-O2A=(\text{delta } D1+\text{delta } D2+\text{delta } d1+\text{delta } d2)/2\ \sin(\text{alpha}/2)$$

because an angle alpha of the V-shaped surface is designed as 90 degrees, $$\text{delta erroneous } V=(\text{delta } D1+\text{delta } D2+\text{delta } d1+\text{delta } d2)/\sqrt{2}$$

compared with each other, on the aspect of locating error values, delta erroneous circle is larger than delta erroneous V, on the aspect of locating shifting directions, the bulb center probably shifts in any direction in the former, and the bulb center only shifts in the up-down direction of the V-shaped surface in the latter.

According to the universal type mounting structure for a car lamp bulb and the assembly method thereof, firstly, in terms of own shape, the area formed by the three fan-shaped lug bosses is set into the shape of the waist-shaped slot, so that the preparation for the motion location of the supporting seat (3) in a horizontal direction is made; a pair of the guide surfaces (13) extending longitudinally in the axial direction as well as the two V-shaped locating surfaces (14) at an angle of 90 degrees and extending longitudinally in the axial direction are symmetrically arranged on the wall of the second cylindrical hole (9), so that the preparation for the motion location of the bulb base in the horizontal direction is made;

secondly, through the lug boss (12) arranged on the supporting seat (3) as well as the clamping foot (4) located on the contact piece (1), the supporting seat (3) and the bulb base are fixed into an integer for motion;

thirdly, the contact type pressing slice (16) is arranged on the wall of the second cylindrical hole (9) and opposite to the V-shaped locating surfaces;

the contact type pressing slice (16) is used for providing initial thrust in the radial direction of the supporting seat (3), so that the supporting seat (3) takes the translational motion in the radial direction, and meanwhile, the supporting seat (3) drives the bulb base to take the translational motion in the radial direction;

then, for further improving the structure, an auxiliary component is additionally arranged; the contact piece (17) is arranged on the wall of the second cylindrical hole (9) and between the two V-shaped locating surfaces (14), the elastic pieces (18) are arranged on two ends of the contact piece (17) in directions extending towards a circle center, and the elastic pieces (18) are used for propping the bulb back to the initial mounting position when the bulb is screwed out; the pentagonal lug boss (19) is arranged on the supporting seat (3), and the pentagonal lug boss (19) is used for providing screw-in and screw-out hand feeling force; and the four elastic contact pieces (20) are uniformly arranged on the periphery of the contact piece (1), and the elastic contact pieces (20) are used for improving electromagnetic compatibility by contacting with the metal shell of the back starter after the bulb is mounted in place.

According to the universal type mounting structure for a car lamp bulb and the assembly method thereof, not only are high mounting convenience and dismounting convenience (single-hand mounting can be performed) guaranteed, but also the universality (the universal type mounting structure for a car lamp bulb is suitable for multiple discharge bulbs) is improved, a screwing angle is large (obvious mounting hand feeling is guaranteed) and can be randomly adjusted within a specific range, and besides radial mounting accuracy is improved (the universal type mounting structure is directly located on a reflecting mirror in both axial direction and radial direction). In addition, the structure is small, and the electromagnetic compatibility can be improved.

What is claimed is:

1. A universal type mounting structure for a car lamp bulb is used for mounting the car lamp bulb by being cooperated with a bulb base, which comprises a first contact piece (1), a reflecting mirror mounting part (2) and a supporting seat (3), wherein the supporting seat (3) is arranged in the reflecting mirror mounting part (2); the universal type mounting structure for a car lamp bulb is characterized in that the first contact piece (1), which is cooperated with the supporting seat (3), comprises a clamping foot (4), a semi-circular pressing sheet (5) and a row of pressing sheet (6);

the row of pressing sheet (6) is arranged on the first contact piece (1) in manner of extending towards the two sides by taking a position opposite to the clamping foot (4) as a datum point;

the reflecting mirror mounting part (2) comprises a first cylindrical hole (7), a first supporting plane (8), a second cylindrical hole (9), a second supporting plane (10), three fan-shaped lug bosses, a lug boss (12), a pair of guide surfaces (13) and two V-shaped locating surfaces (14); wherein the first supporting plane (8) is arranged between the first cylindrical hole (7) and the second cylindrical hole (9) and extends from a radial periphery outside the first cylindrical hole (7) to an inner diameter of the second cylindrical hole (9);

the second supporting plane (10) is arranged in manner of extending from the radial periphery outside the second cylindrical hole (9);

the three fan-shaped lug bosses comprising a fan-shaped lug boss 1 (11-1), a fan-shaped lug boss 2 (11-2) and a fan-shaped lug boss 3 (11-3) respectively are distributed on the first supporting plane (8) and an inner wall of the second cylindrical hole (9), and an area formed by the three fan-shaped lug bosses is in the shape of a waist-shaped slot;

the first contact piece (1) is arranged on the second supporting plane (10);

the supporting seat (3) is arranged in the waist-shaped slot formed by the three fan-shaped lug bosses, a square lug boss (12) is arranged on the supporting seat (3), and the square lug boss (12) is located just below the clamping foot (4) in an axial direction, so that the supporting seat (3) cannot drop out of the reflecting mirror mounting part (2);

the pair of guide surfaces (13) which are axially arranged are symmetrically arranged on the wall of the second cylindrical hole (9), and the two V-shaped locating surfaces (14) at an angle of 90 degrees are arranged on the wall of the second cylindrical hole (9) along the axial direction.

2. The universal type mounting structure for the car lamp bulb according to claim 1, wherein the reflecting mirror mounting part (2) further comprises a limiting lug boss (15) that is arranged between the fan-shaped lug boss 1 (11-1) and the fan-shaped lug boss 2 (11-2) and on a side surface of the fan-shaped lug boss 1 (11-1), a left side surface of the limiting lug boss (15) and the side surface of the lug boss (12) located on the supporting seat (3) are cooperated to limit the position of a bulb being screwed in, and a right side surface of the fan-shaped lug boss 1 (11-1) and the side surface of the lug boss (12) located on the supporting seat (3) are cooperated to limit the position of a bulb being screwed out and prevent reverse screw.

3. The universal type mounting structure for the car lamp bulb according to claim 1, wherein the reflecting mirror mounting part (2) further comprises a contact type pressing slice (16) that is arranged on a wall of the second cylindrical hole (9) and opposite to the V-shaped locating surfaces (14), and the contact type pressing slice (16) is used for providing thrust in a radial direction for the supporting seat (3), so that the supporting seat (3) takes translational motion in the radial direction.

4. The universal type mounting structure for the car lamp bulb according to claim 1, wherein the universal type mounting structure further comprises a second contact piece (17) is arranged on the wall of the second cylindrical hole (9) and between the two V-shaped locating surfaces (14), elastic pieces (18) are arranged on two ends of the second contact piece (17) in directions extending towards a circle center.

5. The universal type mounting structure for the car lamp bulb according to claim 1, wherein the reflecting mirror mounting part (2) further comprises a pentagonal lug boss (19) that is arranged on the supporting seat (3).

6. The universal type mounting structure for the car lamp bulb according to claim 1, wherein the reflecting mirror mounting part (2) further comprises four elastic contact pieces (20) which are uniformly arranged along the periphery of the first contact piece (1).

7. The universal type mounting structure for the car lamp bulb according to claim 1, wherein the center angle of the arc length is adjustable between 6 and 50 degrees, the arc is formed between a side surface of the fan-shaped lug boss 1 (11-1) and the limiting lug boss (15).

8. The method for assembling the universal type mounting structure for the car lamp bulb with the bulb according to claim 2, wherein the bulb comprises the bulb base, a flange, a square notch and a semi-circular notch, the flange is formed on the bulb base, and the square notch and the semi-circular notch are formed in the flange; through the bulb base, the bulb and the universal type mounting structure for a car lamp bulb are assembled according to the following steps:

S1: the square notch formed in the flange of the bulb base is aligned to the clamping foot (4) located on the first contact piece (1), the semi-circular notch formed in the flange of the bulb base is aligned to the semi-circular pressing sheet (5) located on the first contact piece (1), the bulb is butted with the supporting seat (3) through the second cylindrical hole (9) and the first cylindrical hole (7) sequentially, and the square notch formed in the flange of the bulb base penetrates through the clamping foot (4) and in clearance fit with the lug boss (12) located on the supporting seat (3);

S2: the bulb is rotated, and the supporting seat (3) is driven and radially rotates in a direction from the fan-shaped lug boss 1 (11-1) to the limiting lug boss (15);

S3: when the supporting seat (3) rotates to the position of the contact type pressing slice (16), the contact type pressing slice (16) applies radial thrust to the supporting seat (3), the supporting seat (3) rotates and translates at the same time under the driving of the radial thrust and axial rotary force, and the bulb base rotates and translates at the same time under the action of the driving of the supporting seat (3) as well as applied own rotary force;

S4: when the supporting seat (3) is pushed into the narrow part of the waist-shaped slot in the radial direction, the supporting seat (3) rotates to the limiting lug boss (15) at the same time, the bulb base is pushed into the V-shaped locating surfaces (14) in the radial direction;

three-point fixation on the bulb base is formed by the clamping foot (4), the semi-circular pressing sheet (5) and the row pressing sheet (6).

9. The method for assembling the universal type mounting structure for the car lamp bulb with the bulb according to claim 8, wherein three bumps are uniformly formed on the bottom plane of the flange of the bulb base;

in step S4, when the bulb rotates in place, the three bumps move to the upper surfaces of the three fan-shaped lug bosses.

* * * * *